US005400689A

United States Patent [19]

Hütter et al.

[11] Patent Number: 5,400,689

[45] Date of Patent: Mar. 28, 1995

[54] DEVICE FOR STORING A MISSLE IN A LAUNCHER TUBE

[75] Inventors: Horst Hütter, Tegernsee; Dietmar Puttinger, Munich, both of Germany

[73] Assignee: Deutsche Aerospace, Munich, Germany

[21] Appl. No.: 184,257

[22] Filed: Jan. 21, 1994

[51] Int. Cl.[6] ..... F41F 3/042; F41F 3/052

[52] U.S. Cl. ..... 89/1.816

[58] Field of Search ..... 89/1.816, 1.810, 1.819

[56] References Cited

U.S. PATENT DOCUMENTS

| | | | |
|---|---|---|---|
| H405 | 1/1988 | Covey | 89/1.816 |
| 2,478,774 | 8/1949 | Meinel | 89/1.816 |
| 2,998,754 | 9/1961 | Bialy | 89/1.816 |
| 3,038,382 | 6/1962 | Noyes et al. | 89/1.816 |
| 3,857,321 | 12/1974 | Cohen | 89/1.810 |
| 4,357,855 | 11/1982 | Merg | 89/1.816 |
| 4,410,151 | 10/1983 | Höppner et al. | 89/1.816 |
| 4,470,336 | 9/1984 | Swann et al. | 89/1.819 |
| 4,604,940 | 8/1986 | Mendelsohn et al. | 89/1.816 |
| 5,115,711 | 5/1992 | Bushagour et al. | 89/1.816 |
| 5,168,119 | 12/1992 | Sands | 89/1.816 |

*Primary Examiner*—David Brown
*Attorney, Agent, or Firm*—McGlew and Tuttle

[57] ABSTRACT

A device for storing a missile 8 includes at least one adjustable and spring-loaded support point 11, 31 and at least two fixed support points 12 and 32 each are present in a launcher tube in the front and in the rear. The front support points 11, 12 act on support pins 10 arranged on the jacket of the missile 8, and the rear support points 12, 32 act on sliding ribs 35 arranged on supports 33 for wings 34 that can be folded out, wherein all support points are supported on frames 3 and 4 of a launching container 1.

12 Claims, 3 Drawing Sheets

DEVICE FOR STORING A MISSLE IN A LAUNCHER TUBE

FIELD OF THE INVENTION

The present invention pertains to a device for storing a missile in a launcher tube, wherein the launcher tube is mounted in a launching container.

BACKGROUND OF THE INVENTION

In prior-art missile-storing means, the missiles are always placed into the launcher tubes with some clearance. A launching container, which is also used as the launcher tube, in which the missile is guided with four guide projections between two rails each during storage and during launching, has been known from DE 33 25 626 A1. With this structure, there is clearance between the guide projections both radially and in relation to the rails. All these prior-art missile-storing means with clearance have the disadvantage that excessive loads acting on the missile occur during transport and launching due to the introduction of vibrations.

SUMMARY AND OBJECTS OF THE INVENTION

The primary object of the present invention is to design a device of the type described in the introduction such that a missile-storing means that is adjustable without clearance, which avoids dangerous rattling vibrations, is made possible.

According to the invention, a device for storing a missile in a launcher tube is provided wherein the launcher tube is mounted in a larger container. The launcher container includes frame means for supporting the launching tubes within the container. The container includes a spring-loaded adjustable support point and two fixed support points. The spring-loaded adjustable support point and the fixed support point each include parts filling a gap between the launching tube and the launching container to align the launching tube in the launching container. The adjustable spring-loaded support points each include an adjusting screw. The adjusting screw to the adjustable and spring-loaded support points are supported on the frame means of the launching container. The adjustable and spring-loaded support points are preferably provided with two in the front, as well as two fixed support points and two in the rear, as well as two fixed support points. The front support points are in contact with support pins arranged in contact with the missile. The rear support points are supported on sliding ribs arranged in contact with supports for wings of the missile. The wings are preferably in a folded state within the launcher tube and can be folded out for deployment of the missile.

It is possible according to the present invention both to store and to launch a missile without clearance. Rattling vibrations with their consequences in terms of impaired accuracy of sighting and unacceptable loads on missile components are avoided. Another major advantage is the fact that the clearance-free storage of the missile makes possible satisfactory zero measurement of the homing head, so that .accurate determination of the position in the tube can be performed. Since the adjustable and spring-loaded support points represent the direct connection with the missile, ideal flux of force is achieved between the missile, the launcher tube, and the launching container.

The launcher tube can be simplified because of this favorable introduction of force into the launching container, as a result of which considerable cost savings are achieved.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
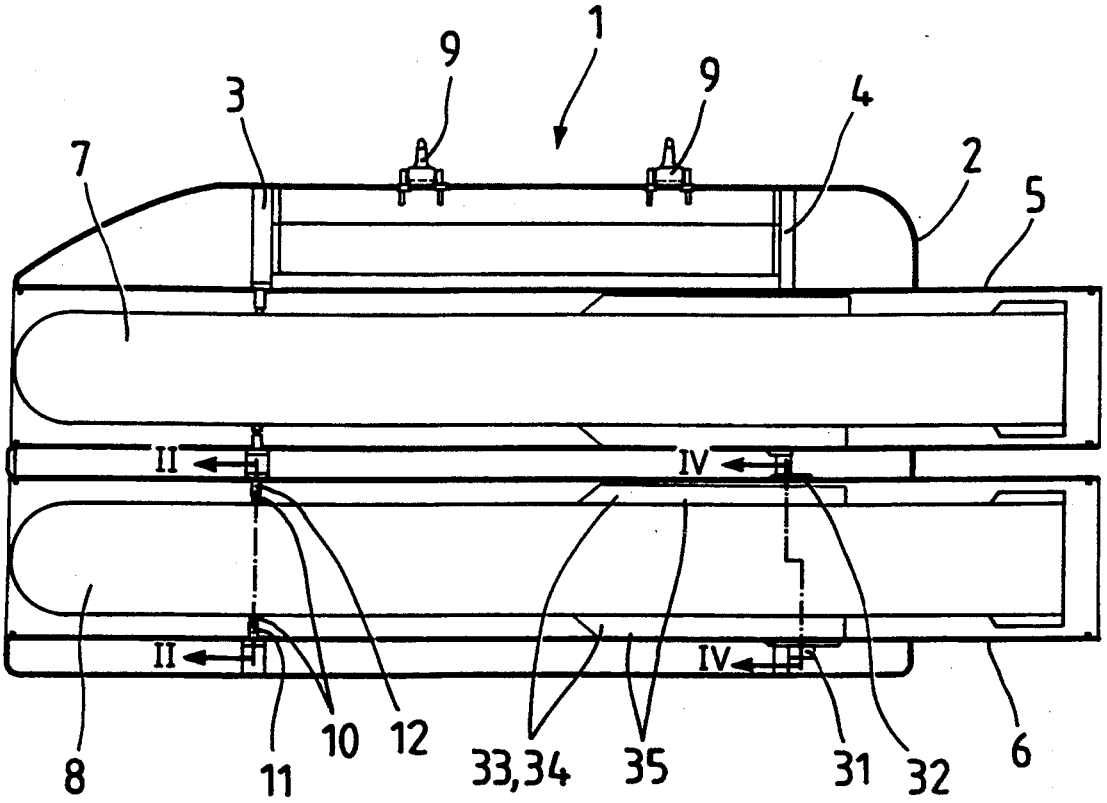
FIG. 1 is a sectional view showing a launching container with two launcher tubes.

A launching container 1 is represented in FIG. 1 in a greatly reduced and simplified form. The launching container 1 has a housing 2, which is reinforced by frames 3 and 4 and can be attached to an airplane with lugs 9. Two launcher tubes 5 and 6 with two missiles 7 and 8 are placed into the housing 2. The storage of the missiles 7 and 8 in the launcher tubes 5 and 6 and in the launching container 1 is shown in the other figures based on the example of the missile 8.

Figure 2:
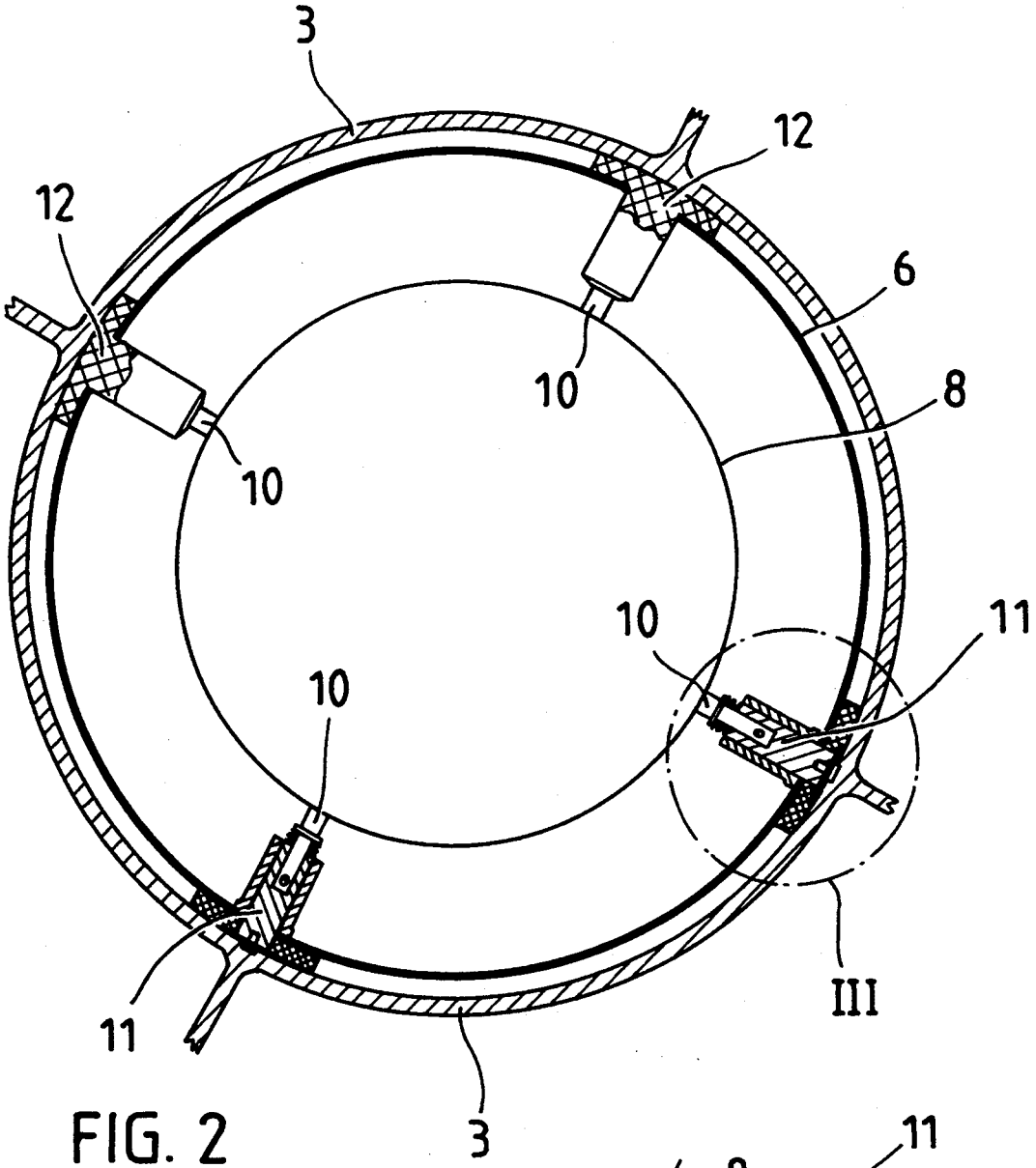
FIG. 2 is a sectional view taken through the launching container corresponding to lines II—II in FIG. 1.
Figure 3:
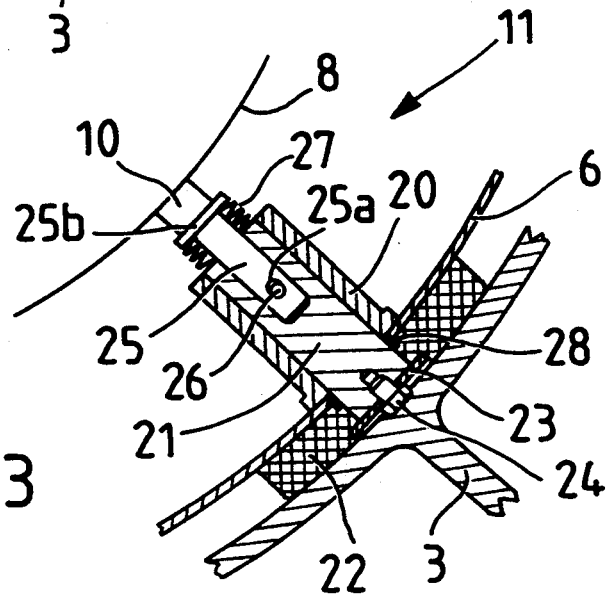
FIG. 3 is an enlarged representation of a front, adjustable and spring-loaded support point according to point III in FIG. 2.

FIG. 2 shows the front storage for the missile 8 with two adjustable and spring-loaded support points 11 and two fixed support points 12 each. All four the support points 11 and 12 are mounted in the launcher tube 6, and are supported after mounting by the frame 3 of the launching container. The design of one of the two adjustable and spring-loaded support points 11 is shown in FIG. 3. An adjusting screw 21, which is supported by means of a safety plate 23 in a flanged disk 22 attached to the launcher tube 6 on the outside, is screwed into a housing 20. The safety plate is secured with a locking screw 24 secured against rotation. A thrust piece 25 is inserted into the adjusting screw 21 and is limitedly movable in an elongated hole **25*a* due to a locking pin 26. A pretensioned spring 27 is inserted between a shoulder 25*b* of the thrust piece 25 and the adjusting screw 21. The shoulder 25*b* is consequently in spring-loaded contact with a support pin 10 arranged on the missile 8. A seal 28 is provided between the flanged disk 22 and the launcher tube 6. The front, fixed support points 12 have the shape of a plug, which is firmly inserted into the launcher tube 6; they are supported by the frame 3, and are in contact with the support pins 10**.

Figure 4:
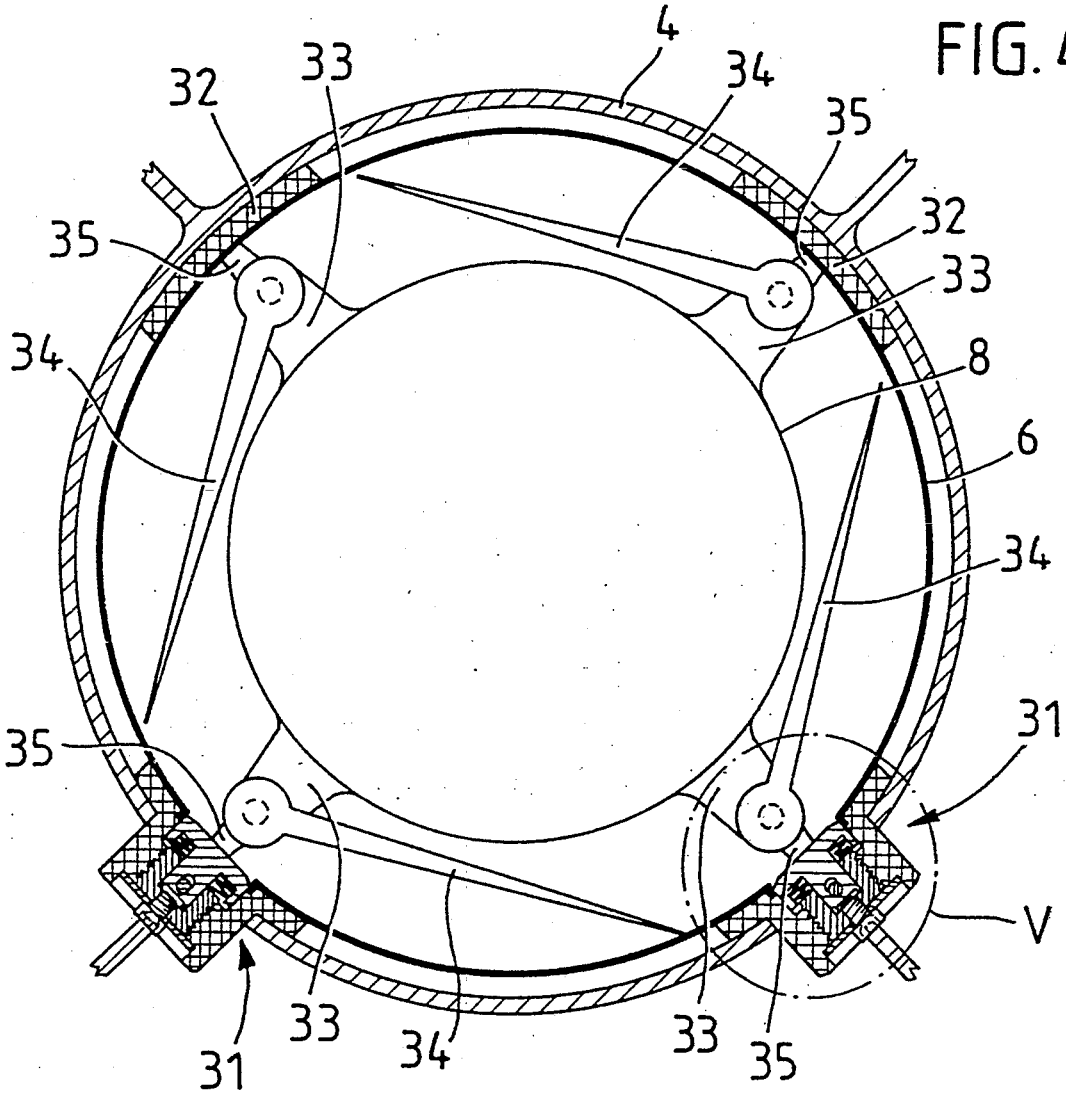
FIG. 4 is a section through the launching container corresponding to lines IV—IV in FIG. 1.
Figure 5:
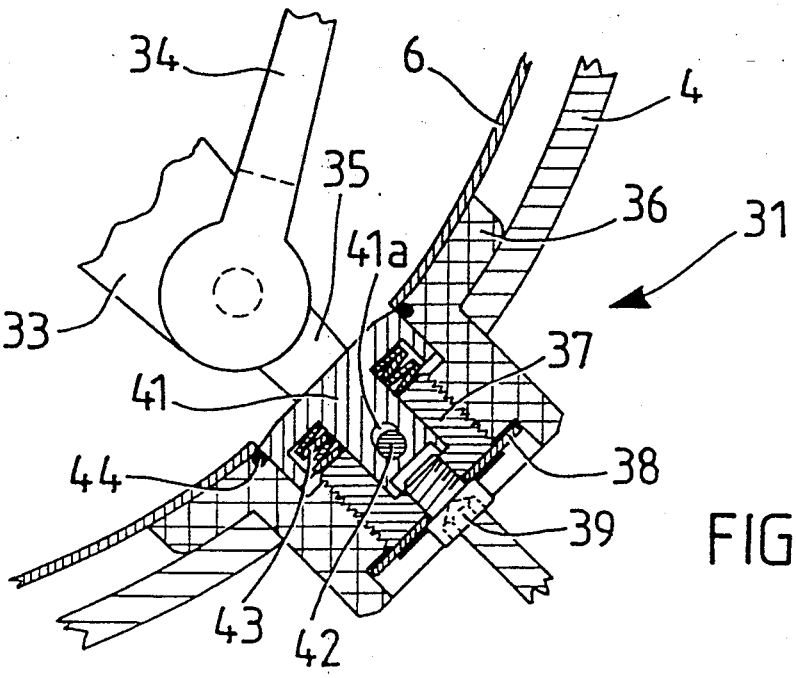
FIG. 5 is an enlarged representation of a rear, adjustable and spring-loaded support point according to point V in FIG. 4.

FIGS. 4 and 5 show the rear support points for the missile 8 with two adjustable and spring-loaded support points 31 and two fixed support points 32, which are supported at the rear frame 4 of the launching container 1. The support points 31 and 32 are located in the rear part of wing supports 33 for wings 34 that can be folded in. The wing supports 33 are provided with sliding ribs 35, with which the missile 8 can slide during the start of the launcher tube 6 (cf. FIG. 1). In the adjustable and spring-loaded support point 31, an adjusting screw 37, which is secured by a safety plate 38 and a locking screw 39, is screwed into a housing 36. The thrust piece 41 is inserted into the adjusting screw 37 and is limitedly movable in an elongated hole 41*a* due to a locking pin 42. A spring 43, which presses the thrust piece 41 against the sliding rib 35, is located between the adjusting screw 37 and the thrust piece 41. The thrust piece 41 is inserted into the launcher tube 6 with a seal 44. The two fixed support points 32 have the shape of an elongated hole, which is connected to the launcher tube 6 and is supported on the frame 4.

Providing three or five support points instead of four support points both in the front and in the rear, wherein at least one adjustable support point and at least one spring-loaded support point must be present, is also within the scope of the present invention.

While a specific embodiment of the invention has been shown and described in detail to illustrate the application of the principles of the invention, it will be understood that the invention may be embodied otherwise without departing from such principles.

What is claimed is:

1. A device for storing a missile in a launcher tube, comprising:

a launching container;

a launcher tube positioned in the launching container;

frame means for supporting said launcher tube in said launching container;

front support points connected to said launching container including at least one adjustable and spring-loaded front support point and two fixed front support points;

rear support points including an adjustable spring-loaded rear support point and two fixed rear support points, said front support points and said rear support points each including a support point part filling a part of a gap between said launcher tube and said launching container to align said launcher tube in said launching container; and said front and rear adjustable and spring-loaded support points each include an adjusting screw supported on said frame means.

2. A device according to claim 1, wherein:

said support point part, at said front support points comprises flanged disks positioned on said launcher tube on an outside of said launcher tube at said adjustable and spring-loaded support point and head parts of a plug at said fixed support points, said flanged disks and said head parts of said plug being introduced on an outside into said launcher tube.

3. A device according to claim 1, wherein:

said support point part at said rear support points comprises a flange of a housing for said adjustable and spring-loaded support point and an elongated plate at said fixed support points.

4. A device according to claim 1, wherein:

said front, adjustable and spring-loaded support point includes a housing located within said launcher tube, said adjusting screw being screwed into said housing passing from an outside through said launcher tube, said adjusting screw being supported by said support point part which comprises a flanged disk, said flanged disk filling said gap between said launcher tube and said launching container at said front adjustable and spring-loaded support point, said flanged disk being connected to said launcher tube on an outside of said launcher tube by a safety plate, said front support points being in contact with support pins arranged on said missile, a thrust piece acting against one of said support pins with a shoulder, is inserted into said adjusting screw wherein said thrust piece is fastened movably via an elongated hole in said adjusting screw and a pretensioned spring is inserted between said shoulder and said thrust piece and said adjusting screw.

5. A device according to claim 4, wherein:

said adjusting screw is secured against rotation in said flanged disk via a locking screw acting on said safety plate after a clearance free adjustment of said missile in said launcher tube.

6. A device according to claim 1, wherein:

said rear support points are supported on sliding ribs which are arranged on supports for wings of said missile, said rear adjusting screw accommodates in it a thrust piece acting against one of said sliding ribs, said rear adjustable and spring-loaded support point including a housing with said adjusting screw screwed into said housing, wherein said thrust piece is fastened movably over an elongated hole in said adjusting screw with a locking pin, and a pretensioned spring is inserted between said thrust piece and said adjusting screw.

7. A device according to claim 6, wherein:

said adjusting screw is secured by a safety plate and a locking screw after a clearance-free adjustment of the missile in the launcher tube.

8. A device according to claim 1, wherein:

said front support points include two adjustable and spring-loaded front support points and said two fixed front support points and said rear support points include two adjustable and spring-loaded rear support points and said two fixed rear support points, said front support points contacting support pins arranged on said missile, and said rear support points contacting sliding ribs arranged on wing supports for wings of said missile, said wings being foldable.

9. A device according to claim 8, wherein:

said support point part comprises at said front support points comprises flanged disks positioned on said launcher tube on an outside of said launcher tube at said adjustable and spring-loaded support point and head parts of a plug at said fixed support points, said flanged disks and said head parts of said plug being introduced on an outside into said launcher tube.

10. A device according to claim 8, wherein:

said support part at said rear support points comprises a flange of a housing for said adjustable and spring-loaded support point and an elongated plate at said fixed support points.

11. A device according to claim 8, wherein:

said front, adjustable and spring-loaded support point includes a housing located within said launcher tube, said adjusting screw being screwed into said housing passing from an outside through said launcher tube, said adjusting screw being supported by said support part which comprises a flanged disk, said flanged disk filling said gap between said launcher tube and said launching container at said front adjustable and spring-loaded support point, said flanged disk being connected to said launcher tube on an outside of said launcher tube by a safety plate, said front support points being in contact with support pins arranged on said missile, a thrust piece acting against one of said support pins with a shoulder, is inserted into said adjusting screw wherein said thrust piece is fastened movably via an elongated hole in said adjusting screw and a pretensioned spring is inserted between said shoulder and said thrust piece and said adjusting screw.

12. A device according to claim 8, wherein:

said rear support points are supported on sliding ribs which are arranged on supports for wings of said missile, said rear adjusting screw accommodates in it a thrust piece acting against one of said sliding ribs, said rear adjustable and spring-loaded support point including a housing with said adjusting screw screwed into said housing, wherein said thrust piece is fastened movably over an elongated hole in said adjusting screw with a locking pin, and a pretensioned spring is inserted between said thrust piece and said adjusting screw.

* * * * *